US006213632B1

(12) United States Patent
Danielsson et al.

(10) Patent No.: US 6,213,632 B1
(45) Date of Patent: Apr. 10, 2001

(54) APPARATUS FOR TREATING AN AQUEOUS WORKING MEDIUM BY SHEARING IN ANNULAR TREATMENT SLOTS OF VARYING SIZES

(75) Inventors: Magnus Danielsson, Sundsvall; Kjell Forslund, Sundsbruk; Klas Kriström, Kovland, all of (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/445,038

(22) PCT Filed: Jun. 3, 1998

(86) PCT No.: PCT/SE98/01052

§ 371 Date: Feb. 14, 2000

§ 102(e) Date: Feb. 14, 2000

(87) PCT Pub. No.: WO98/55212

PCT Pub. Date: Dec. 10, 1998

(30) Foreign Application Priority Data

Jun. 4, 1997 (SE) ..... 9702119

(51) Int. Cl.[7] ..... B01F 5/04

(52) U.S. Cl. ..... 366/165.3; 366/171.1; 366/172.1; 366/304

(58) Field of Search ..... 366/168.1, 171.1, 366/172.1, 172.2, 304, 306, 317, 262, 263, 265, 292, 293, 302, 165.3; 162/57, 243

(56) References Cited

U.S. PATENT DOCUMENTS 1,670,593 * 5/1928 Miller .
1,890,106 * 12/1932 Bendixen .
2,321,599 * 6/1943 Hofmann .
2,645,464 * 7/1953 Forbes .
3,253,300 * 5/1966 Gove et al. .
3,907,456 * 9/1975 Krienke .
4,096,587 * 6/1978 Haller .
4,231,666 * 11/1980 Baron .
4,416,548 11/1983 Carre et al. .
4,915,509 * 4/1990 Sauer et al. ..... 366/304
5,590,961 * 1/1997 Rasmussen ..... 366/317
5,813,758 * 9/1998 Delcourt et al. ..... 366/304

FOREIGN PATENT DOCUMENTS

451928 * 10/1948 (CA) ..... 366/317
1466804 * 3/1989 (SU) ..... 366/304

* cited by examiner

*Primary Examiner*—Charles E. Cooley
(74) *Attorney, Agent, or Firm*—Lerner, David, Littenberg, Krumholz & Mentlik, LLP

(57) ABSTRACT

Apparatus for treating an aqueous medium with a treatment fluid including a housing forming a treatment chamber, a rotatable rotor arranged in the treatment chamber, and including a number of rotor rings carried by the rotatable rotor and coaxially arranged at the periphery of the rotatable rotor, a number of stationary stator rings coaxially inserted between the rotor rings thus forming a number of annular axial treatment slots which have a radial size between the rotor rings and the stationary stator rings, the radial size of these slots increasing with increasing distance from the axis of the rotatable rotor, an inlet for delivering the working medium and the treatment fluid to one side of the annular axial treatment slots and an outlet for the treated working media disposed at the other side of the annular axial treatment slots, whereby the working medium is sheared in the treatment slots during operation so that substantially homogeneous shearing velocities are achieved in each of these slots.

16 Claims, 5 Drawing Sheets

APPARATUS FOR TREATING AN AQUEOUS WORKING MEDIUM BY SHEARING IN ANNULAR TREATMENT SLOTS OF VARYING SIZES

FIELD OF THE INVENTION

The present invention relates to a method and apparatus for treating an aqueous working medium, preferably a pulp suspension, and in particular a paper pulp suspension, with at least one treating fluid. In this connection, the expression aqueous working medium is intended to mean clean liquids, solutions, and suspensions, such as fiber suspensions. In this description the utilization of the present invention for treating pulp suspensions will primarily be described, since this invention has its principal application in this field, but it must be emphasized that it in no way is limited to this technical field.

BACKGROUND OF THE INVENTION

To provide paper pulp with its desired properties, such as proper brightness, the paper pulp is treated with one or more different treating fluids, for instance chlorine gas or oxygen. The pulp is therefore continuously conducted into a treatment device, in which the treatment fluid or fluids are brought into contact with the pulp fibers. In order to achieve optimal treatment results it is important that the fibers contact the treatment fluid as uniformly as possible, and for that reason fibers should be spread out to the greatest possible extent, and the treatment fluid should be homogeneously distributed in the suspension.

In prior so called low intensity devices the concentration of the treatment fluid of the pulp has been medium low to low in order to achieve the desired even quality of the fully treated pulp. These low intensity treatment devices have, to an ever increasing extent, been replaced by high intensity treating devices with a high concentration of the treatment fluid in relation to those previous types. Current devices of this latter type, however, unfortunately suffer from the drawback that the treatment zone, where the working medium undergoes shearing in order to mix the fibers and is subjected to the treatment fluid, does not show a completely homogenous shearing field. As a consequence, either (1) a part of the suspension will be incompletely treated, or (2) a part of the suspension will be "overtreated."

The treatment according to (1) results in a homogeneously treated final product, whereas a treatment according to (2) means that too much treating fluid must be supplied to the suspension and/or that unnecessarily high energy needs to be supplied to the pulp suspension.

Both of these alternatives add to the costs.

A treatment device of this type for treating pulp suspensions is disclosed in Swedish Patent No. 8001970-6, corresponding to U.S. Pat. No. 4,416,548. This device comprises an axial inlet for the pulp suspension, which opens into a mixing chamber, in which a rotor is arranged. The pulp is fed through and is sheared in an annular slot, which is delimited by a stator ring and the rotor. The supply fluid is conducted through an axial inlet to the plane end surface of the rotor and thereafter flows radially along this surface up to and into the shearing slot where it is mixed with the suspension. Thereafter, the treated pulp flows out through a tangential outlet arranged after the slot. As shown in FIGS. 7 and 8 of this Swedish publication, the shearing area may be divided into several annular shearing slots having the same radial extension formed by several rotor connected rotor rings, which are inserted between interconnected stator rings.

Since the present invention to a substantial extent is based on this known technique, reference is made to this publication for a more detailed description of the principal construction. However, it should be noted that this known solution suffers from the above stated shortcomings with respect to inhomogeneous shearing fields.

The object of the present invention is to provide a method and apparatus of the above kind to treat a working medium by a treatment fluid, which provide a treatment zone with a shearing field which allows a substantially homogenous treatment of the working medium at a lower price than has heretofore been possible.

SUMMARY OF THE INVENTION

In accordance with the present invention, this and other objects have now been realized by the invention of apparatus for treating an aqueous working medium with at least one treatment fluid, comprising a housing forming a treatment chamber, in which the aqueous working medium is to be treated with the at least one treatment fluid in a treatment zone, a rotatable rotor arranged in the treatment chamber to rotate about an axis, the rotatable rotor including a plurality of rotor rings carried by the rotatable rotor and coaxially arranged at the periphery of the rotatable rotor, a plurality of stationary stator rings coaxially inserted between the plurality of rotor rings, thereby forming a plurality of annular axial treatment slots having a radial size between the rotor rings and the stationary stator rings, the radial size of the annular axial treatment slots increasing with increasing distance from the axis of the rotatable rotor, inlet means for delivering the aqueous working medium and the at least one treatment fluid to one side of the annular axial treatment slots, and outlet means for the treated aqueous working media disposed at the other side of the annular axial treatment slots, whereby the aqueous working medium is sheared in the annular axial treatment slots during operation so that a substantially homogenous shearing velocity is achieved in each of the annular axial treatment slots. In a preferred embodiment, the radial size of each of the plurality of annular axial treatment slots is directly proportional to the radius of the surface of the one of the rotor rings defining each of the plurality of annular axial treatment slots.

In accordance with one embodiment of the apparatus of the present invention, the inlet means includes an inlet housing connected to the housing, the inlet housing including a cylindrical inlet chamber and having a tangential working medium inlet whereby the aqueous working medium forms a swirl in the cylindrical inlet chamber before it enters the treatment chamber.

In accordance with another embodiment of the apparatus of the present invention, the inlet means includes a treatment fluid inlet member, and the apparatus includes distribution means associated with the rotatable rotor, the treatment fluid inlet member including an opening spaced from the distribution means whereby the distribution means distributes the at least one treatment fluid radially towards the annular axial treatment slots. In a preferred embodiment, the distribution means comprises a substantially annular disc. In another embodiment, the opening in the treatment fluid inlet member is axially adjustable relative to the distribution means.

In accordance with another embodiment of the apparatus of the present invention, the apparatus includes throttling means for the aqueous working medium arranged between the inlet means for the aqueous working medium and the treatment chamber, whereby the aqueous working medium is provided with a turbulent flow before it enters the treatment chamber.

In accordance with another embodiment of the apparatus of the present invention, the housing includes a further treatment zone for further treatment of the aqueous working medium with a further treatment fluid arranged in the flow path of the aqueous working medium in the treatment chamber. Preferably, the inlet means includes a first treatment fluid inlet member and a second treatment fluid inlet member for supplying a further treatment fluid to the treatment zone, one of the first and second treatment fluid inlet members being arranged within the other of the first and second treatment fluid inlet members. In a preferred embodiment, both of the first and second treatment fluid inlet members are axially adjustable independently of each other.

In accordance with another embodiment of the apparatus of the present invention, the inlet means includes a treatment fluid inlet member for the further treatment fluid and the apparatus includes first and second distribution means associated with the rotatable rotor, the treatment fluid inlet member including an opening spaced from the first and second distribution means, whereby the first and second distribution means distribute the treatment fluid and the further treatment fluid radially towards the annular axial treatment slots. In a preferred embodiment, the first and second distribution means comprise first and second annular plates spaced apart and arranged substantially perpendicular to the axis.

In accordance with another embodiment of the apparatus of the present invention, the apparatus includes a radial throttling disc connected to the rotatable rotor and forming the further treatment zone, whereby the further treatment zone provides a lower mechanical working intensity than the treatment zone.

In accordance with another embodiment of the apparatus of the present invention, the plurality of rotor rings comprises a first plurality of rotor rings, and the plurality of stationary stator rings comprises a first plurality of stationary stator rings, and the apparatus includes a second plurality of rotor rings carried by the rotor and coaxially arranged in the further treatment zone and a second plurality of stationary stator rings coaxially arranged in the further treatment zone between the second plurality of rotor rings thereby forming a second plurality of annular axial treatment slots. Preferably, the second plurality of treatment slots include a radial size which increases with increasing distance from the axis of the rotor. In a preferred embodiment, the treatment zone and the further treatment zone are adapted to provide different shearing velocities.

BRIEF DESCRIPTION OF THE DRAWINGS

In the following detailed description various embodiments of the present invention will be described in more detail with reference to the accompanying drawings, in which.

DETAILED DESCRIPTION

Figure 1:
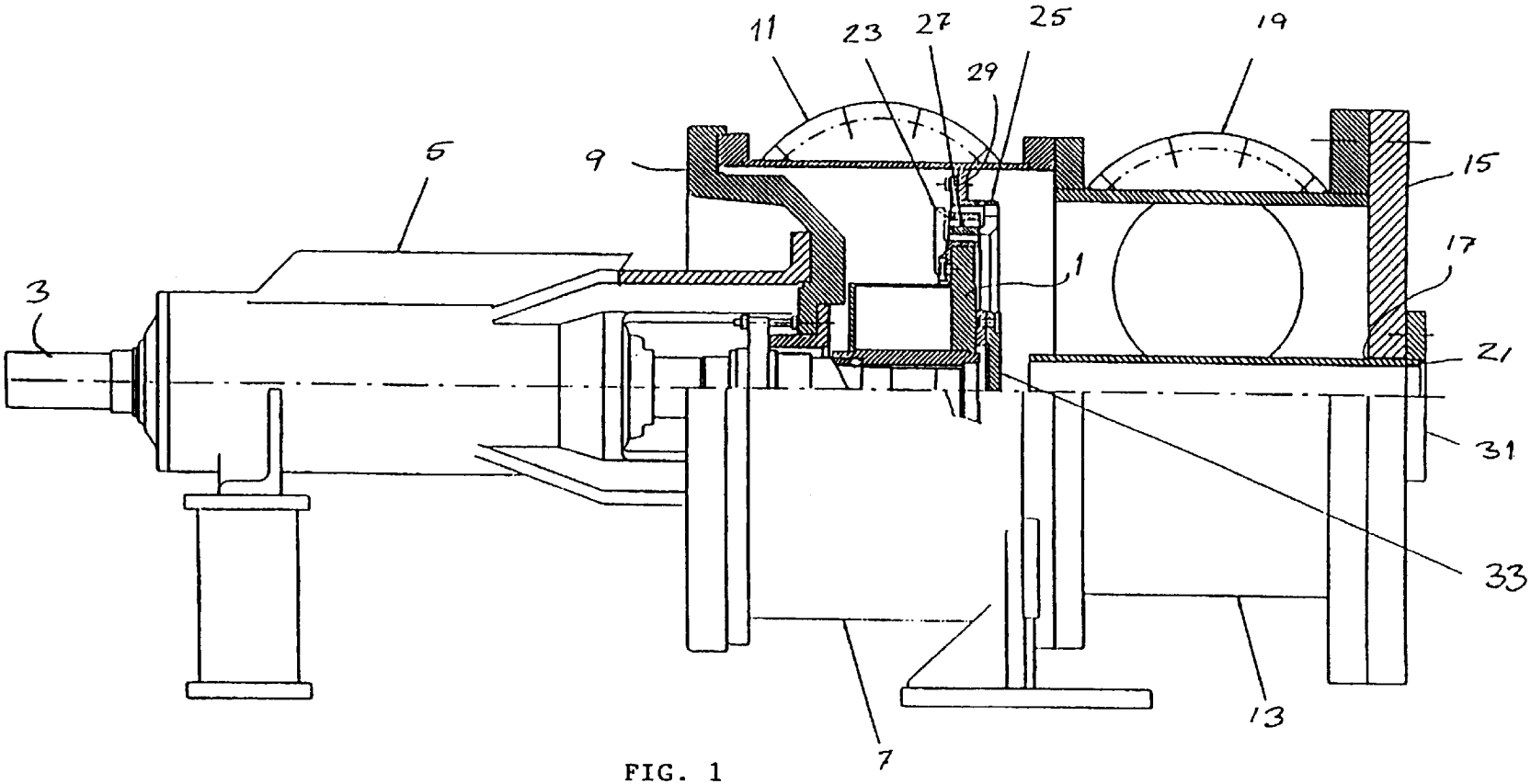
FIG. 1 is a side, elevational, partially sectional view of a first embodiment of the present invention.

With reference to FIG. 1, a first embodiment of the apparatus according to the invention comprises a rotor 1, which is fixed on an elongated shaft 3, which is rotatably journalled in a bearing unit 5, which is not shown in detail. The disc shaped rotor 1 rotates in a cylindrical mixing or treatment chamber formed by a main housing 7, which is covered at the bearing unit side by an end gable 9. The rotor shaft 3 extends through the end gable 9 and is sealed to the latter with traditional sealing means to prevent leakage. A tangential 7 outlet 11 discharges the treated working medium, which in this case is a paper pulp suspension from the treatment chamber. The suspension enters into the treatment chamber 7 from an inlet housing 13, which is connected to the latter and which in the opposite end is sealed with an end place 15, comprising a central extension 17. A pulp suspension is fed into the inlet housing 13 through an inlet member 19. An inlet member in the form of a pipe connection 21, which opens just ahead of the rotor disc 1 is intended to conduct the treatment fluid for treating the working medium to the chamber.

At the periphery of the rotor disc 1 a number of concentrical rings 23 are rigidly connected to the rotor to rotate with the rotor as a unit. On the inside 1 of the cylinder wall of the main housing 7 a corresponding coaxial ring arrangement 25 is fixed to a flange 29, which is secured to the cylinder wall. The rotor rings 23 and the stator rings 25 are coaxially interconnected and dimensioned so that several ring shaped shearing slots 27 are formed between them (see also FIG. 5). Up to this point, this construction corresponds to the apparatus described in the above-mentioned Swedish Patent No. 8001970-6, and particularly to FIGS. 7 and 8 with their associated text. Thus, the pulp suspension is fed through the inlet member 19 into the inlet housing 13, from which it is conducted to the treatment chamber of the main housing 7, and is pushed through the ring slots 27 formed by the rotor rings and the stator rings, 23 and 25, respectively, in which ring slots 27 the pulp suspension is simultaneously subjected to shearing. The treatment fluid flows through the fluid inlet member 21 towards the rotor disc and is radially deflected towards the ring slots 27, in which it affects and joins the pulp suspension. After finished treatment in the treatment zone the treated suspension is discharged through the outlet 11.

The first embodiment shown in FIG. 1 differs from the prior art in many respects. A substantial functional difference is that the inlet member 19 in the inlet housing 13 for the pulp suspension is tangential. This arrangement causes the pulp to already rotate in the inlet housing, which increases the dynamic movements of the liquid and is very favorable to mixing with the treatment fluid, and which minimizes the energy required for guiding the suspension into the treatment zone. Furthermore the inlet housing can be assembled in an optional angle to the main housing 7. This makes possible various assemblage alternatives, which provides a great freedom of choice with respect to installation and pipelining.

The inlet member 21, into one opening 31 of which the treatment fluid is supplied to be discharged under pressure through the opposite opening of the pipe, can be axially adjustable to adjust the distance to a distribution plate 33 connected to the rotor 1 in response to the amount and properties of the treatment fluid and the suspension. The treatment fluid strikes this distribution plate after having exited the inlet member 21, and then flows radially along the latter and is spread like a plume along plate 33 up to the treatment zone.

A great advantage of the proposed solution is that the rotor disc 1 with the rotor rings 23 can be removed as a unit without the need to remove pipelinings and other equipment. At the same time the stator rings 25 are also uncovered, so that the treatment zone can be readily cleaned and inspected when necessary.

As mentioned previously the known multi-slot solution suffers from the shortcoming that the shearing fields in the treatment zone are inhomogeneous, resulting in the drawbacks stated in the introductory portion of this description.

Figure 5:
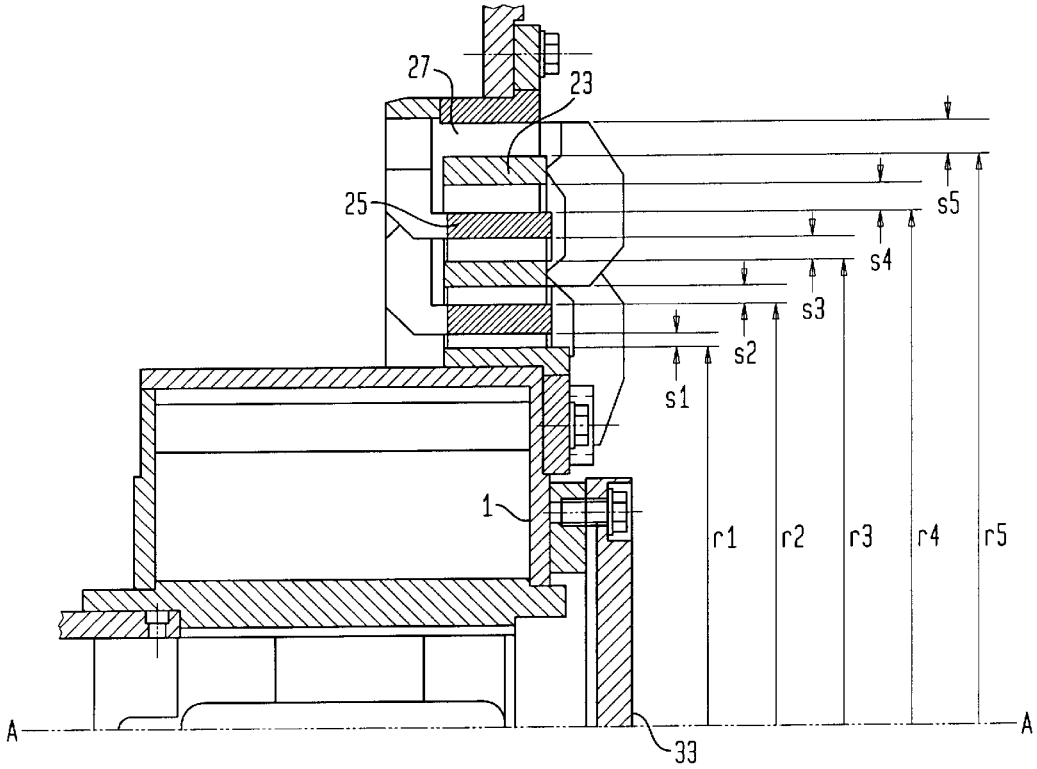
FIG. 5 is an enlarged, elevational, sectional view of an embodiment of the slot area of the treatment zone of the present invention, in which $S_1<S_2<S_3<S_4<S_5$.

The present invention solves this problem by the particular design and dimensioning of the ring slots, whereby reference is now made to FIG. 5 showing a section on a larger scale of the under half of the treatment zone. In this drawing the stationary stator rings 25 are square cross-hatched, whereas the rotor rings 23 are only obliquely cross-hatched.

The object of the present invention is to provide for mechanical treatment of the pulp suspension which is uniform in all slots in the treatment zone. This object is realized according to the present invention by making the shearing velocity invariably the same in all slots, which is exemplified in the following discussion with reference to FIG. 5 by a device having five slots.

The rotational axis of the rotor is denoted by section A—A, the radial distance from this axis to a rotor ring is denoted by $r_1$ and the current radial extension of the slot is denoted by $s_1$. Other numerals which are utilized in the formula below are $v_1$=velocity at the radius $r_1$ in m/sec, $\omega$ is the angular velocity in radius/sec and $\gamma$ is the shearing velocity $s^{-1}$ in the slot.

A condition according to the present invention is now that the shearing velocity shall be the same and constant in all of the slots, i.e. that $$\gamma = v_1/s_1 = \text{constant in all slots},$$

$s_1 = r_1\omega/\gamma$, i.e. that the radial extension of the slot shall be proportional to the radius of the rotor ring surface which limits the current slot.

Angular velocity and shearing velocity are operational parameters which are predetermined with respect to the special treatment to which the suspension is to be subjected.

It should be noted that the ring packages can be readily exchanged for treatment under other operational parameters. In such a case it is noted that the radial extensions of the slots are changed. According to the new treatment conditions in accordance with the above formula. Suitable radii and ring thicknesses can be readily calculated from the slot geometry and the particular given operational conditions.

By the design according to the present invention homogenous and constant shearing fields are obtained in all slots in the treatment zone with the required strong relative movements between the various fibers in the pulp suspension.

Thus, the various slots have increasing radial extensions or widths, the further away from the rotor axis A—A of the device they are. Typically, the radial extension varies between about 4 and 20 mm, the number of the ring slots can be from two up to about ten.

In the further description of embodiments hereof the same reference numerals have been maintained in order to denote identical or similar elements.

Figure 2:
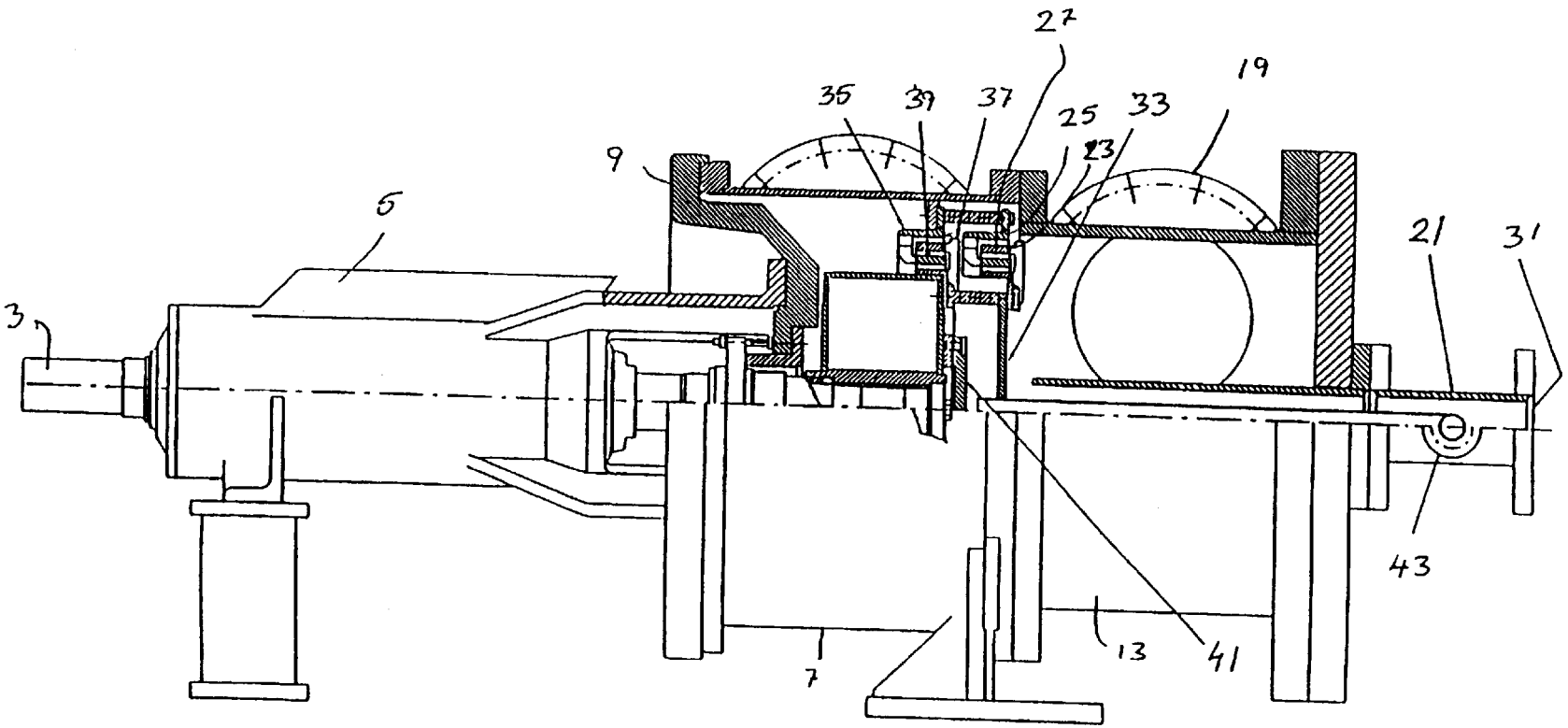
FIG. 2 is a side, elevational, partially sectional view of a second embodiment of the present invention.

In FIG. 2 an embodiment is shown which in principle is designed in the same manner as the above described embodiment with respect to slot widths, but which differs from the first embodiment in that it comprises two separate slot treatment zones, 27 and 39, both of which are composed of coaxially arranged rotor rings 23 and 37, respectively, and stator rings, 25 and 35, respectively. In the same manner as previously discussed a tubular treatment fluid inlet member 25 extends to the distribution plate 33 to radially distribute the treatment fluid to the first treatment zone 27.

The second slot ring package consisting of stator rings 35 and rotor rings 37 is arranged axially downstream of the first slot ring package at the same level thereof and with the same number of slots. This second zone is provided with a second treatment fluid through a second fluid inlet member 43, which is arranged in the first fluid inlet member 21 and which opens just ahead of a second distribution plate 41, which radially distributes the second treatment fluid to the second treatment zone 37. The first distribution plate comprises a central passage for the second inlet member 43 and both the first and the second inlet members are individually axially adjustable to optimize the mixing procedure. The distribution plate 33 also prevents the various treatment fluids from being mixed with one another and for this reason there is only a thin slot of several millimeters or less between the second inlet member 43 and the distribution plate 33, which consequently functions as a dynamic seal.

As in the case discussed above, the pulp suspension is supplied through the tangential inlet member 19 of the inlet housing 13 and is thereafter fed to the first treatment zone, and the first treatment fluid is supplied to the pulp just ahead of the inlet in the slot treatment zone. From the first treatment zone the pulp flows on towards the second treatment zone, with the second treatment fluid being supplied to the pulp just ahead of the inlet of the second slot zone.

In this manner, for example two different fluids can in an optimal manner be supplied for treating pulp under optimal conditions. Previously, one has either been forced to supply two different fluids to one and the same inlet, in which case at least one of the treatment fluids will not be utilized under optimal treatment conditions, or one is forced to use a costly series treatment with a first treatment fluid in a first treatment device and a second treatment fluid in a second treatment device. Furthermore, it should be noted that one and the same treatment fluid can, of course, be supplied to both inlets, for instance in order to obtain a differentiated supply of this fluid.

By the above-described "twin" arrangement the suspension can now be treated in a single device. Although the treatment zones are substantially the same, with the same number of slots at the same level, this does not have to be the case, but the zones may be located at different levels and have different numbers of zones in order to optimally adjust each of the treatments to the requirements of the treatment fluids and the pulp suspension.

Figure 3:
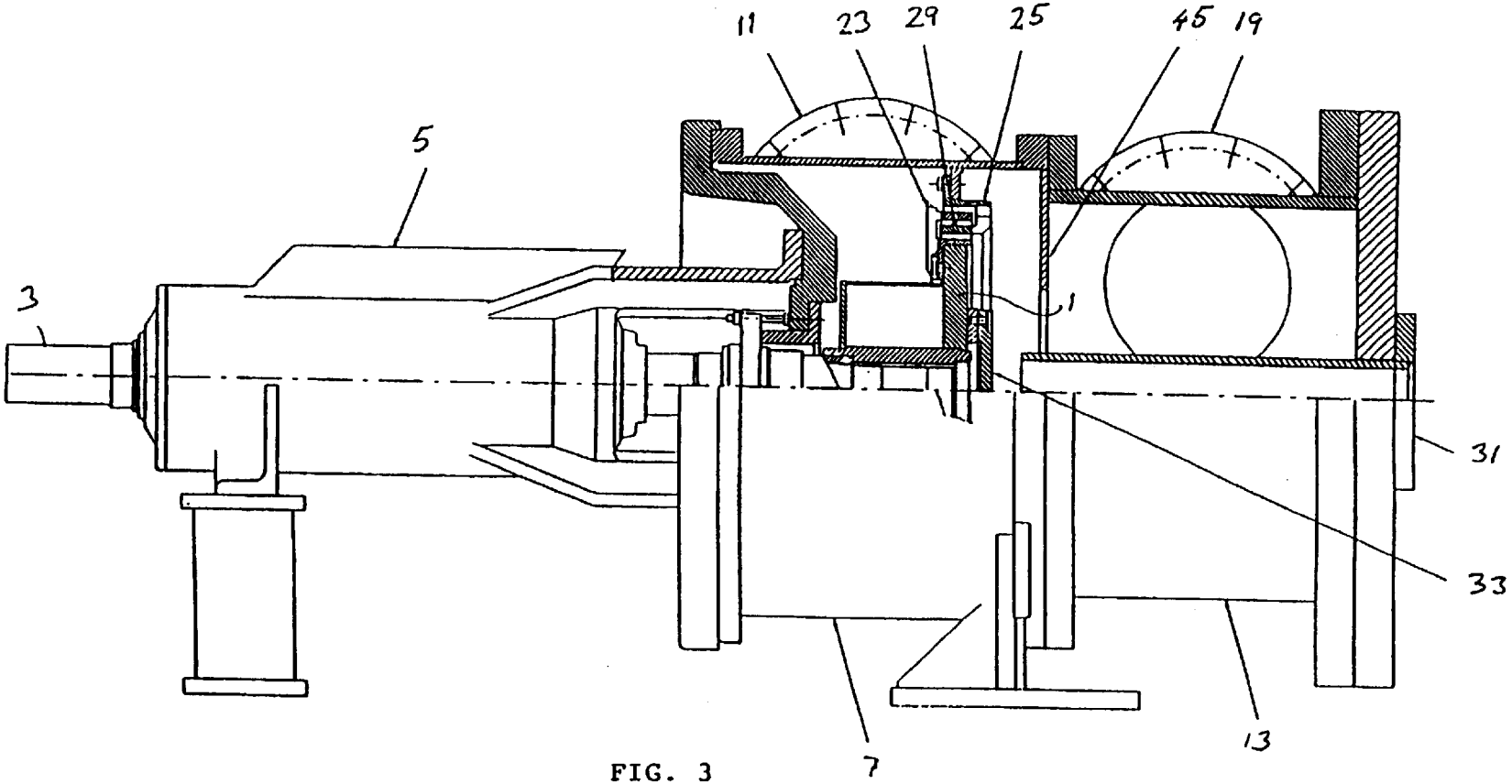
FIG. 3 is a side, elevational, partially sectional view of a modification of the present invention.

FIG. 3 shows a modification of the device shown in FIG. 1. In this case there is provided throttling means 45 which is arranged in the inlet housing 13 just ahead of the inlet to the mixing chamber of the main housing 7. The purpose of this throttling means is to provide the pulp with a more turbulent flow before it enters the treating zone itself. The throttling means 45 also contributes to a good initial distribution in the pulp stream. Of course, this modification can also be utilized in the twin embodiment.

Figure 4:
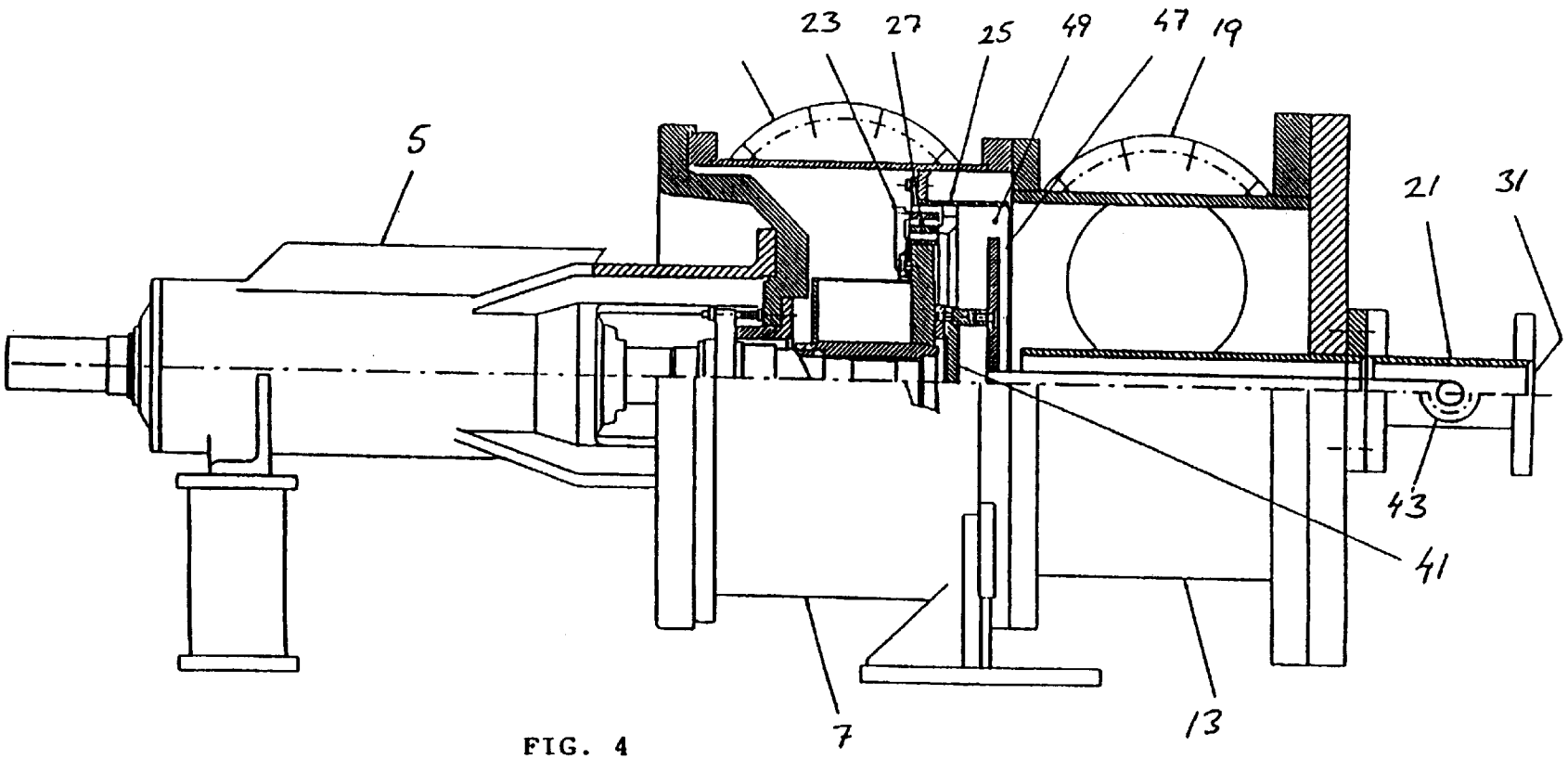
FIG. 4 is a side, elevational, partially sectional view of a further modification of the present invention.

A further modification, which can be said to be somewhat in between the embodiment according to figure I and the twin embodiment according to FIG. 2, can be seen in FIG. 4. In this case, one identifies the treatment chamber with a single associated slot treatment zone formed by rotor rings 23 and stator rings 25. In this case there is no similar second slot treatment zone, in spite of the fact that there are two inlet members, 21 and 43, respectively, one of which is arranged in the other, and which opens in front of a distribution plate 41 to the slot treatment zone. On the rotor there is a throttling disc 47 arranged with a passage for the inner inlet pipe 43 in the middle portion. The throttling disc forms a second treatment zone 49 in the mixing chamber upstream of the slot treatment zone with a considerably lower mixing intensity than the latter. Two different treatment fluids with substantially different requirements with respect to treatment can be supplied. For instance, steam may be fed into the inlet member 21 to the throttling disc 47, which is mixed with the pulp in the low intensity zone 49 while a suitable treatment chemical is conducted through the inner inlet member 43 to the slot treatment zone.

In all of these embodiments the ring packages can be disassembled from the bearing unit side.

Although the invention herein has been is described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for treating an aqueous working medium with at least one treatment fluid, comprising:

a housing forming a treatment chamber, in which said aqueous working medium is to be treated with said at least one treatment fluid in a treatment zone, a rotatable rotor arranged in said treatment chamber to rotate about an axis, said rotatable rotor including a plurality of rotor rings carried by said rotatable rotor and coaxially arranged at the periphery of said rotatable rotor, a plurality of stationary stator rings coaxially inserted between said plurality of rotor rings, thereby forming a plurality of annular axial treatment slots having a radial size between said rotor rings and said stationary stator rings, said radial size of said annular axial treatment slots increasing with increasing distance from said axis of said rotatable rotor, inlet means for delivering said aqueous working medium and said at least one treatment fluid to one side of said annular axial treatment slots, and outlet means for the treated aqueous working media disposed at the other side of said annular axial treatment slots, whereby said aqueous working medium is sheared in said annular axial treatment slots during operation so that a substantially homogenous shearing velocity is achieved in each of said annular axial treatment slots.

2. The apparatus of claim 1, wherein said radial size of each of said plurality of annular axial treatment slots is directly proportional to the radius of the surface of the one of said rotor rings defining each of said plurality of annular axial treatment slots.

3. The apparatus of claim 1, wherein said inlet means includes an inlet housing connected to said housing, said inlet housing including a cylindrical inlet chamber and having a tangential working medium inlet whereby said aqueous working medium forms a swirl in said cylindrical inlet chamber before it enters said treatment chamber.

4. The apparatus of claim 1, wherein said inlet means includes a treatment fluid inlet member, and including distribution means connected to said rotatable rotor, said treatment fluid inlet member including an opening spaced from said distribution means whereby said distribution means distributes said at least one treatment fluid radially towards said annular axial treatment slots.

5. The apparatus of claim 4, wherein said distribution means comprises a substantially annular disc.

6. The apparatus of claim 4, wherein said opening in said treatment fluid inlet member is axially adjustable relative to said distribution means.

7. The apparatus of claim 1, including throttling means for said aqueous working medium arranged between said inlet means for said aqueous working medium and said treatment chamber, whereby said aqueous working medium is provided with a turbulent flow before it enters said treatment chamber.

8. The apparatus of claim 1, wherein said housing includes a further treatment zone for further treatment of said aqueous working medium with a further treatment fluid arranged in the flow path of said aqueous working medium in said treatment chamber.

9. The apparatus of claim 8, wherein said inlet means includes a first treatment fluid inlet member and a second treatment fluid inlet member for supplying a further treatment fluid to said treatment zone, one of said first and second treatment fluid inlet members being arranged within the other of said first and second treatment fluid inlet members.

10. The apparatus of claim 9, wherein both of said first and second treatment fluid inlet members are axially adjustable independently of each other.

11. The apparatus of claim 1, wherein said inlet means includes a treatment fluid inlet member for said further treatment fluid and including first and second distribution means connected to said rotatable rotor, said treatment fluid inlet member including an opening spaced from said first and second distribution means, whereby said first and second distribution means distribute said treatment fluid and said further treatment fluid radially towards said annular axial treatment slots.

12. The apparatus of claim 11, wherein said first and second distribution means comprise first and second annular plates spaced apart and arranged substantially perpendicular to said axis.

13. The apparatus of claim 8, including a radial throttling disc connected to said rotatable rotor and forming said further treatment zone, whereby said further treatment zone provides a lower mechanical working intensity than said treatment zone.

14. The apparatus of claim 8, wherein said plurality of rotor rings comprises a first plurality of rotor rings, and said plurality of stationary stator rings comprises a first plurality of stationary stator rings, and including a second plurality of rotor rings carried by said rotor and coaxially arranged in said further treatment zone and a second plurality of stationary stator rings coaxially arranged in said further treatment zone between said second plurality of rotor rings thereby forming a second plurality of annular axial treatment slots.

15. The apparatus of claim 14, wherein said second plurality of treatment slots include a radial size which increases with increasing distance from said axis of said rotor.

16. The apparatus of claim 15, wherein said treatment zone and said further treatment zone are adapted to provide different shearing velocities.

* * * * *

UNITED STATES PATENT AND TRADEMARK OFFICE

CERTIFICATE OF CORRECTION

PATENT NO. : 6,213,632 B1
DATED : April 10, 2001
INVENTOR(S) : Danielsson et al.

It is certified that error appears in the above-identified patent and that said Letters Patent is hereby corrected as shown below:

Title page,
Item [54], delete "OF VARYING SIZES".
Item [86], "Feb. 14, 2000" should read "Feb. 16, 2000" (both occurrences).

Column 1,
Lines 4-5, delete "OF VARYING SIZES".

Column 8,
Line 30, delete "1" and insert therefor -- 8 --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*